350-333 SR
XR 4,060,802

United States TX350-333 4,060,802
Matsuki Nov. 29, 1977

[54] DRIVING CIRCUIT FOR A LIQUID CRYSTAL DISPLAY DEVICE

[75] Inventor: Koji Matsuki, Yokohama, Japan

[73] Assignee: Tokyo Shibaura Electric Co., Ltd., Kawasaki, Japan

[21] Appl. No.: 699,187

[22] Filed: June 23, 1976

[30] Foreign Application Priority Data

June 24, 1975 Japan ..... 50-78051

[51] Int. Cl.[2] ..... G09F 9/32

[52] U.S. Cl. ..... 340/324 M; 340/336; 350/160 LC

[58] Field of Search ..... 340/324 M, 336, 166 EL; 350/160 LC

[56] References Cited

U.S. PATENT DOCUMENTS

| | | | |
|---|---|---|---|
| 3,911,421 | 10/1975 | Alt et al. | 340/324 M |
| 3,936,676 | 3/1976 | Fujita | 340/324 M |
| 3,949,242 | 4/1976 | Hirasawa | 340/336 |
| 3,969,717 | 7/1976 | Hatsukano | 340/336 |
| 3,969,719 | 7/1976 | Sirocka | 340/336 |
| 4,005,403 | 1/1977 | Washizuka et al. | 340/336 |

OTHER PUBLICATIONS

Fairchild, TTL Family (Catalog), Oct., 1970, p. 52.

*Primary Examiner*—Marshall M. Curtis
*Attorney, Agent, or Firm*—Oblon, Fisher, Spivak, McClelland & Maier

[57] ABSTRACT

A liquid crystal display element-driving circuit wherein output signals from a decoder for decoding coded time data are supplied to a plurality of exclusive OR gates through the corresponding NAND gates; an output signal from a liquid crystal driving pulse generator is sent forth in common to the exclusive OR gates, and outputs from the respective exclusive OR gates are conducted to the corresponding segment electrodes of the liquid crystal display element, and which further comprises first and second logical level voltage-generating circuits; switch circuits controlled by said first and second logical level voltage-generating circuits, whereby all the segment electrodes can be impressed with voltage having the same logical level by means of said first and second logical level voltage-generating circuits and corresponding switch circuits.

5 Claims, 5 Drawing Figures

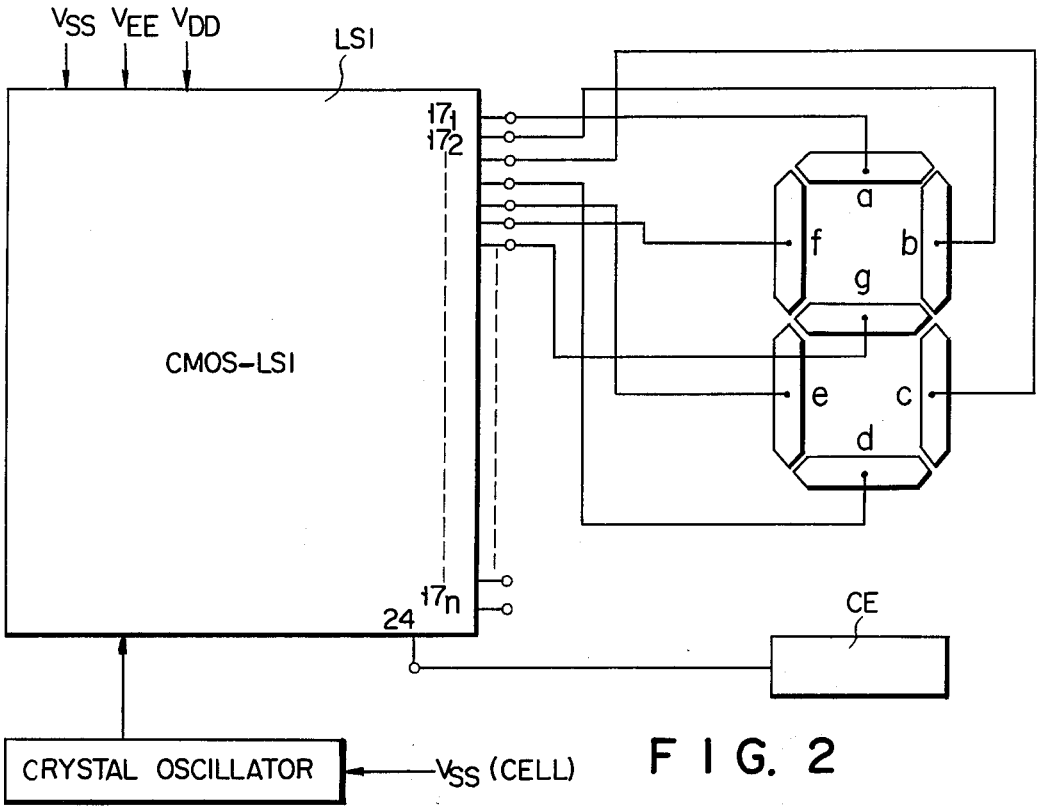
FIG. 2
FIG. 3
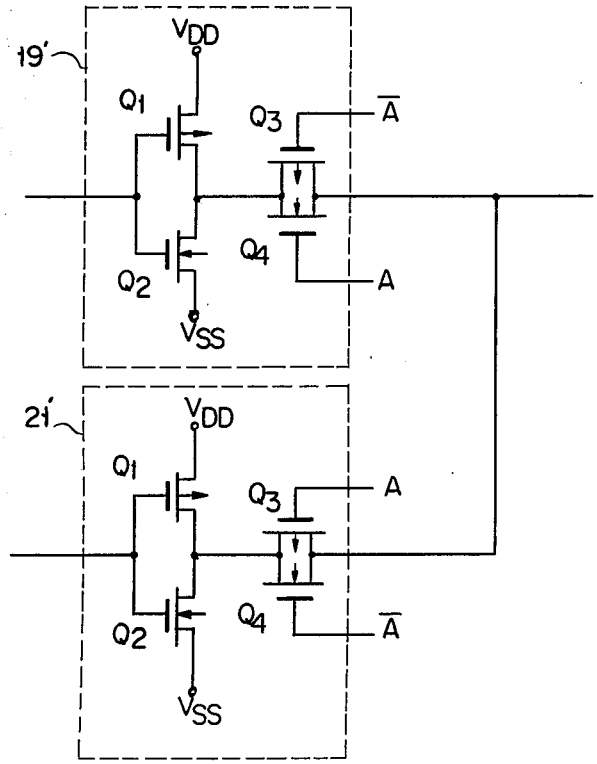

DRIVING CIRCUIT FOR A LIQUID CRYSTAL DISPLAY DEVICE

BACKGROUND OF THE INVENTION

This invention relates to a liquid crystal display element-driving circuit and more particularly to the digital circuit used in a digital display electronic timepiece.

In recent years, an electronic timepiece using liquid crystal as a display element has been developed and marketed. The electronic timepiece contains a large scale integration (abbreviated as "LSI") circuitry. The LSI circuitry includes various time data-handling circuits such as an oscillating circuit, frequency-dividing circuit, counter circuit, decoder circuit and output circuit. The output circuit supplies liquid crystal-driving pulses to the required segment electrodes of a liquid crystal display element. The output circuit has a plurality of output terminals provided in a number corresponding to that of the segment electrodes, thereby causing the liquid crystal display element to indicate a prescribed time data.

Measurement of output voltage and current from the respective segment electrodes of a liquid crystal display element was carried out by a very much complicated process with respect to a prior art output circuit, because some of the segment electrodes were operated at a high logical level "H" and the others at a low logical level "L". Consequently, said measurement failed to be finished quickly.

For example, in the measurement of high or low level output current from arbitrary terminal of a segment electrode, the potential of the terminal must be fixed to logical high or low level by proper means, because each terminal was impressed with A.C. voltage and time-consuming work were required to measure the high or low logical level current of all the terminals of the LSI circuitry for a liquid crystal display element which were provided in as large a number as about 40 to 50.

Further, the LSI circuitry of a liquid crystal display timepiece is generally operated by a cell, and is accompanied with the drawbacks that even when a crystal oscillator ceases to carry out oscillation due to a decrease in the power of the cell, a certain level of D.C. voltage continues to be impressed across the segment electrodes of a liquid crystal display element and a common segment electrode facing them; and said D.C. voltage is undesirably applied to liquid crystal sealed between both forms of electrode, thereby deteriorating the liquid crystal and shortening its effective life.

SUMMARY OF THE INVENTION

It is accordingly the object of this invention to provide a liquid crystal display elment driving circuit in which measurement of the output high or low level current and voltage are easily executed by setting all the output terminal for driving the liquid crystal to the same high or low logical level voltage at the same time, and further, the protection of the liquid crystal is easily realized by preventing it from being impressed with D.C. voltage between the segment electrode when crystal oscillation is stopped as a result of the reduction of the output voltage of the cell.

According to an aspect of this invention, there is provided a liquid crystal display element-driving circuit, wherein output signals from a decoder circuit are conducted to a plurality of exclusive OR gates through the corresponding NAND gates; and output signal from a liquid crystal driving pulse generating circuit is supplied in common to the respective exclusive OR gates; and output signals from the exclusive OR gates are delivered to the corresponding segment electrodes of a liquid crystal display element, and which comprises a first logical level voltage-generating circuit connected in common to the input terminals of a plurality of multi-input type NAND gates; a second logical level voltage-generating circuit connected in common to the inputs of the exclusive OR gates; and switch circuits disposed between the driving pulse-generating circuit and second logical level voltage-generating circuit on one hand and the exclusive OR gates on the other and controlled by the first logical level voltage generating-circuit, thereby enabling all segment electrodes to be selectively supplied with liquid crystal-driving pulses or with high "H" or low "L" logical level voltage according to combinations of output signals from the first and second logical level voltage-generating circuits.

According to another aspect of this invention, there is provided a liquid crystal display element-driving circuit, which further comprises a crystal oscillation stop-detecting circuit for detecting the stoppage of crystal oscillation when voltage impressed on a crystal oscillator drops for some reason, for example, a decrease in the power of a cell, whereby, at the stop of crystal oscillation, all the segment electrodes of the liquid crystal display element are impressed with voltage having an equal prescribed logic level, thereby preventing direct current voltage from being applied to the liquid crystal to save it from deterioration and shortened life; in a digital timepiece, indication of time at every time is not always necessary, and when said indication is not required, all the segment electrodes of the liquid crystal display element are set to the same logical level voltage causing the prolongation of the life of the liquid crystal.

BRIEF DESCRIPTION OF THE DRAWING

FIG. 2 indicates the connections of the segment electrodes of a liquid crystal display element to the LSI circuitry;

FIG. 3 presents a modification of the switch circuits 19, 21 of FIG. 1;

DETAILED DESCRIPTION OF THE PREFERRED EMBODIMENTS

Figure 1:
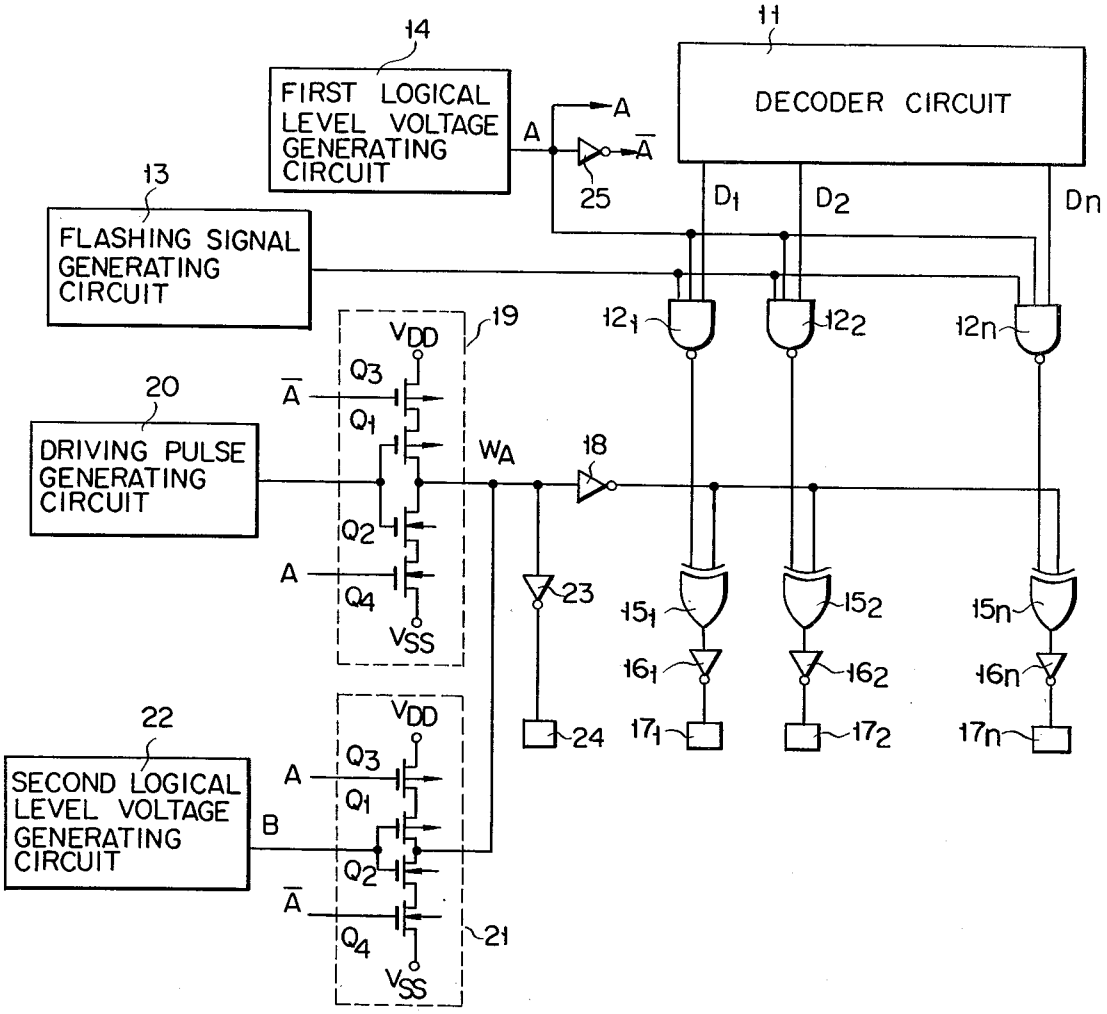
FIG. 1 shows the arrangement of a liquid crystal display element driving circuit according to a first embodiment of this invention which is used with a digital electronic timepiece.

FIG. 1 schematically shows the arrangement of a liquid crystal display element-driving circuit included in the LSI circuitry used with a digital electronic timepiece. The LSI circuitry includes a crystal oscillating circuit, frequency-dividing circuit, counter circuit, decoder circuit and output circuit. Referential numeral 11 denotes a decoder circuit, the output terminals $D_1$ to $D_n$ of which are connected to the corresponding input terminals of a plurality of 3-input type NAND gates $\mathbf{12}_1$ to $\mathbf{12}_n$. The output terminal of a flashing signal-generating circuit 13 and the output terminal of the first logical level voltage-generating circuit 14 are connected in common to the remaining two input terminals of each of said 3-input type NAND gates $12_1$ to $12_n$. The flashing signal generating circuit 13 is used to flash the desired numerals, for example, indicating seconds to discriminate those from other non-flashing numerals, for example, indicating minutes, when the desired numerals are required to change to others, particularly in the case when correct setting of time is required. The flashing signal-generating circuit 13 produces flashing signals repeated at a frequency of about 2 Hz so as to intermittently indicate said particular display digit position. The flashing signal-generating circuit 13 is formed of a simple gate. When a button switch (not shown) mounted on the outside of the body of a digital electronic timepiece is pulled, the gate is opened to supply 2 Hz pulses from the frequency dividing circuit included in the LSI circuitry to that of the NAND gates $12_1$ to $12_n$ which corresponds to the aforesaid particular display digit position. The first logical level voltage-generating circuit 14 is generally formed of a connection electrode or inverter. When the output high or low level current and voltage of the LSI circuit is required to measure, the first logical voltage generating circuit 14 is connected to an external power source which supplies high "H" or low "L" level voltage as required. When connected to an external power source for measurement which is capable of selectively impressing high "H" or low "L" level vo tage, the first logical level voltage-generating circuit 14 may be formed of a connection electrode. An output signal A from the first logical level voltage-generating circuit 14 is changed into an $\bar{A}$ signal while passing through an inverter 25.

The output terminals of the NAND gates $12_1$ to $12_n$ are connected to one input terminal of each of the exclusive OR gates $15_1$ to $15_n$. The output terminals of the exclusive OR gates $15_1$ to $15_n$ are connected through the corresponding inverters $16_1$ to $16_n$ to the segment terminals $17_1$ to $17_n$ which in turn are connected to the segment electrodes of a liquid crystal display element.

As is well known, the segment electrodes are arranged in the form of a numeral 8, as shown in FIG. 2, for each display digit position. A numeral being displayed is determined according to the manner in which the segment electrodes are selectively operated by the LSI circuitry. As seen from FIG. 2, the segment terminals $17_1$ to $17_n$ connected to the segment electrodes *a* to *g* and a common segment terminal 24 connected to a common segment electrode $C_E$ are arranged outside the LSI circuitry. An output from a time-counting circuit included in the LSI circuitry drives the liquid crystal display element.

The other input terminal of each of the exclusive OR gates $15_1$ to $15_n$ is supplied with an output from an inverter 18. The input terminal of the inverter 18 is supplied through a switch circuit 19 with a clock pulse having a frequency of for example, 32 Hz which is produced by a driving pulse-generating circuit 20 and is also impressed through another switch circuit 21 with logical level voltage generated by a second logical level voltage-generating circuit 22 constructed in the same manner as the first logical level voltage-generating circuit 14. Both switch circuits 19, 21 are connected together at a point $W_A$ which acts as wired OR. Output signals from the driving pulse-generating circuit 20 and second logical level voltage-generating circuit 22 are conducted through the switch circuits 19, 21 and another inverter 23 to a common segment terminal 24 connected to a common electrode $C_E$ facing the segment electrodes *a* to *g* of FIG. 2 through liquid crystal.

The driving pulse-generating circuit 20 issues pulses to drive the liquid crystal by alternating current. This driving pulse-generating circuit 20 is a frequency-dividing circuit which is formed of, for example, a flip flop, supplied with pulses from an oscillating circuit included in the LSI circuitry, and generates clock pulses having a prescribed frequency of, for example, 32 Hz.

The switch circuits 19, 21 are clocked inverters, each of which comprises an inverter having a p-channel metal oxide semiconductor (hereinafter abbreviated as "MOS") transistor $Q_1$ and on n-channel MOS transistor $Q_2$ and further comprises a p-channel MOS transistor $Q_3$ and n-channel MOS transistor $Q_4$ connected in series to the power supply sides $V_{DD}$, $V_{SS}$ respectively so as to be used as transfer gates.

With the switch circuit 19, the gate of the n-channel MOS transistor $Q_3$ is supplied with an output $\bar{A}$ from the first logical level voltage-generating circuit 14, and the gate of the p-channel MOS transistor $Q_4$ is supplied with an output A from the first logical level voltage-generating circuit 14. Conversely with the switch circuit 21, the gate of the p-channel MOS transistor $Q_3$ is supplied with an output A from the first logical level voltage-generating circuit 14, and the gate of the n-channel MOS transistor $Q_4$ is supplied with an output $\bar{A}$ from the first logical level voltage-generating circuit 14.

There will now be described the operation of the liquid crystal display element-driving circuit constructed as mentioned above.

a. First, reference is made to the case where the liquid crystal display element-driving circuit is subjected to an ordinary mode. In this case, the flashing signal-generating circuit 13 produces high level "H" D.C. voltage. An output signal A of logical level voltage from the first logical level voltage-generating circuit 14 is converted into a high level "H" form by an external power source for measurement. Since two of the three input terminals of the respective NAND gates $12_1$ to $12_n$ are supplied with high level voltage, decoded outputs from the output terminals of the decoder circuit 11 are inverted by the NAND gates $12_1$ to $12_n$. Inverted outputs are supplied to one input terminal of each of the corresponding exclusive OR gates $15_1$ to $15_n$. At this time, the two transfer gate type MOS transistor $Q_3$, $Q_4$ of the switch circuit 19 are supplied with output signals $\bar{A}$, A respectively from the first logical level voltage-generating circuit 14 and put into operation. As the result, the switch circuit 19 acts as an inverter to invert a clock pulse delivered from the driving pulse-generating circuit 20. The inverted clock pulse is again inverted by the inverter 18 and supplied in common to the other input terminal of the respective exclusive OR gates $15_1$ to $15_n$.

On the other hand, the transfer gate type MOS transistors $Q_3$, $Q_4$ of the switch circuit 21 are supplied with output signals A, $\bar{A}$ respectively from the first logical level voltage-generating circuit 14 and are rendered inoperative, preventing the switch circuit 21 from acting as an inverter.

The above-mentioned event occurs regardless of whether an output signal B from the second logical level voltage-generating circuit 22 represents high "H" or low "L" logical level voltage. In other words, the voltage level of an output from the switch circuit 21 is governed by that of the output from the switch circuit 19. Accordingly, outputs from the exclusive OR gates $15_1$ to $15_n$ have high "H" or low "L" level voltage according to the voltage level of outputs from the decoder circuit 11. Outputs from the exclusive OR gates $15_1$ to $15_n$ are inverted by the corresponding inverters $16_1$ to $16_n$, and supplied to the segment terminals $17_1$ to $17_n$. A clock pulse from the dirving pulse generating circuit 20 is inverted by the switch circuit 19 acting as an inverter and sent forward to the common segment terminal 24 after being again inverted by the inverter 23. Therefore, where one output terminal $D_1$ of the decoder circuit 11 generates a low logical level voltage "L" output, the corresponding three-input type NAND gate $12_1$ produces a high logical level voltage "H" output (because, the remaining two input terminals of the NAND gate $12_1$ are already supplied with high logical level voltage "H"). Where outputs from the switch circuits 19, 21 have low logical level voltage "L" at the point $W_A$, then the common terminal 24 is impressed with high logical level voltage "H" obtained through inversion by the inverter 23. Further, high logical level voltage "H" obtained through inversion by the inverter 18 is supplied to the other input terminals of the exclusive OR circuit $15_1$, which in turn generates low logical level voltage "L" (because both input terminals of said OR circuit $15_1$ are supplied with high level logical voltage "H"). Low logical level voltage "L" generated by the exclusive OR circuit $15_1$ is inverted into a high logical level voltage "H" form by the corresponding inverter $16_1$. As the result, the segment terminal $17_1$ is impressed with high logical level voltage "H". Namely, the common terminal 24 and segment terminal $17_1$ are impressed alike with high logical level voltage "H", namely, with D.C. voltage of the same in-phase. As the result, the liquid crystal of the segment electrode section corresponding to the segment terminal $17_1$ is turned into a nondisplay mode. Conversely where the output terminal $D_1$ of the decoder circuit 11 generates high logical level voltage "H", then an output from the corresponding NAND gate $12_1$ has low logical level voltage "L". Contrary to the above-mentioned case, therefore, the segment terminal $17_1$ and the common terminal 24 are impressed with voltage having different logical levels, namely, with D.C. voltage of reverse in-phase. As the result, the liquid crystal of the segment electrode section corresponding to the segment terminal $17_1$ is turned into a display mode. As described above, D.C. voltage of the same in-phase (nondisplay mode), or D.C. voltage of reverse in-phse (display mode) are impressed across the segment electrodes of the liquid crystal display element and common electrode, thereby effecting a desired pattern of display.

There will now be described the case where rapid measurement on the output high level current and voltage of the segment terminals $17_1$ to $17_n$ is required to see whether or not the values of these current and voltage are reasonable. Output signals A, B from the first and second logical level voltage-generating circuits 14, 22 are made to have low "L" and high "H" voltage levels respectively by an external power source. Now let it be assumed that an output signal A from the first logical level voltage-generating circuit 14 has low voltage level "L". Then the NAND gates $12_1$ to $12_n$ all produce high logical level voltage "H", regardless of whether outputs from the decoder circuit 11 have high "H" or low "L" voltage level. Said high logical level voltage "H" is supplied to the exclusive OR gates $15_1$ to $15_n$.

Further, where an output A from the first logical level voltage-generating circuit 14 has low logical level voltage "L" as mentioned above, then the switch circuit 19 becomes inoperative unlike the aforesaid ordinary case (a) and ceases to act as an inverter. As the result, an output from the liquid crystal driving pulse-generating circuit 20 is shut off by the switch circuit 19 and is not conducted to the inverters 18, 23. In this case, the switch circuit 21 is put into operation contrary to the switch circuit 19 to act as an inverter. Accordingly, an output sisgnal B from the second logical level voltage-generating circuit 22 which was previously chosen to have high voltage level "H" is inverted by the switch circuit 21 into low level "L" form. This low logical level voltage "L" is supplied to the inverters 18, 23. When inverted by the inverter 23, said low logical level voltage "L" is turned into a high level "H" form, which in turn is conducted to the common terminal 24. A low logical level voltage "L" output from the switch circuit 21 is inverted by the inverter 18 into high logical level voltage "H", which in turn is supplied in the common to one input terminal of the respective exclusive OR gates $15_1$ to $15_n$. As the result, the other input terminal of the respective exclusive OR gates $15_1$ to $15_n$ is supplied with an output from the respective NAND gates $12_1$ to $12_n$ which are chosen to produce a high logical level voltage "H" output. Therefore, the exclusive OR gates $15_1$ to $15_n$ generate low logical level voltage "L". Low logical level voltage "L" outputs from the exclusive OR gates $15_1$ to $15_n$ are inverted by the corresponding inverters $16_1$ to $16_n$ into a high level "H" form, causing all the segment terminals $17_1$ to $17_n$ to be all impressed with high logical level voltage "H".

Where all the segment terminals $17_1$ to $17_n$ and the common segment terminal 24 are all impressed with high logical level voltage "H", then the output voltage $V_{OH}$ and output current $I_{OH}$ of the respective terminals can be quickly measured etermined in succession by means of a voltmeter and ammeter (not shown).

c. There will now be described the case where measurement is made to find whether values of current and voltage fall within the specified range, when the segment terminals $17_1$ to $17_n$ and the common segment terminal 24 are all impressed with low logical level voltage "L". Output signals A, B from the first and second logical level voltage are all made to have low logical level voltage "L". In this case, the first and second logical level voltage-generaing circuits 14, 22 are impressed with prescribed low logical level voltage by controlling the operation of an external power source (not shown) capable of selectively producing high "H" or low "L" logical level voltage. As in the preceding case (b), the NAND gates $12_1$ to $12_n$ generate high logical level voltage. The switch circuit 19 does not act as an inverter, while the switch circuit 21 acts as an inverter as in (b). Therefore, a low logical level voltage output B from the second logical level voltage-generating circuit 22 is inverted into a high level "H" form by the switch circuit 21 now acting as an inverter, and further supplied to the inverters 18, 23. As the result, the common segement terminal 24 is impressed with low logical level voltage "L" obtained through inversion by the inverter 23. The exclusive OR gates $15_1$ to $15_n$ supplied with a low level voltage "L" output from the inverter 18 produce high level "H" outputs. These high level "H" outputs from the exclusive OR gates $15_1$ to $15_n$ are inverted by the corresponding inverters $16_1$ to $16_n$ into a low level "L" form. Accordingly, the segment terminals $17_1$ to $17_n$ are all impressed with low logical level voltage "L". Where all the segment terminals $17_1$ to $17_n$ and common segment terminal 24 are all impressed with low logical level voltage "L", then the output voltage $V_{OL}$ and output current $I_{OL}$ of the respective terminals can be quickly measured in succession as in the case of (b) by means of a voltmeter and ammeter.

The switch circuits 19, 21 of FIG. 1 may be replaced by a switch circuit shown in FIG. 3. With the switch circuits 19', 21' of FIG. 3, the transfer gate type MOS transistor $Q_3$, $Q_4$ which were spatially connected in series to the inverter jointly constituted by $Q_1$, $Q_2$ in FIG. 1, are now connected in a parallel manner to the output terminal of the inverter formed of both $Q_1$ and $Q_2$. However, the switch circuits 19', 21' have exactly the same function as those of FIG. 1.

Figure 4:
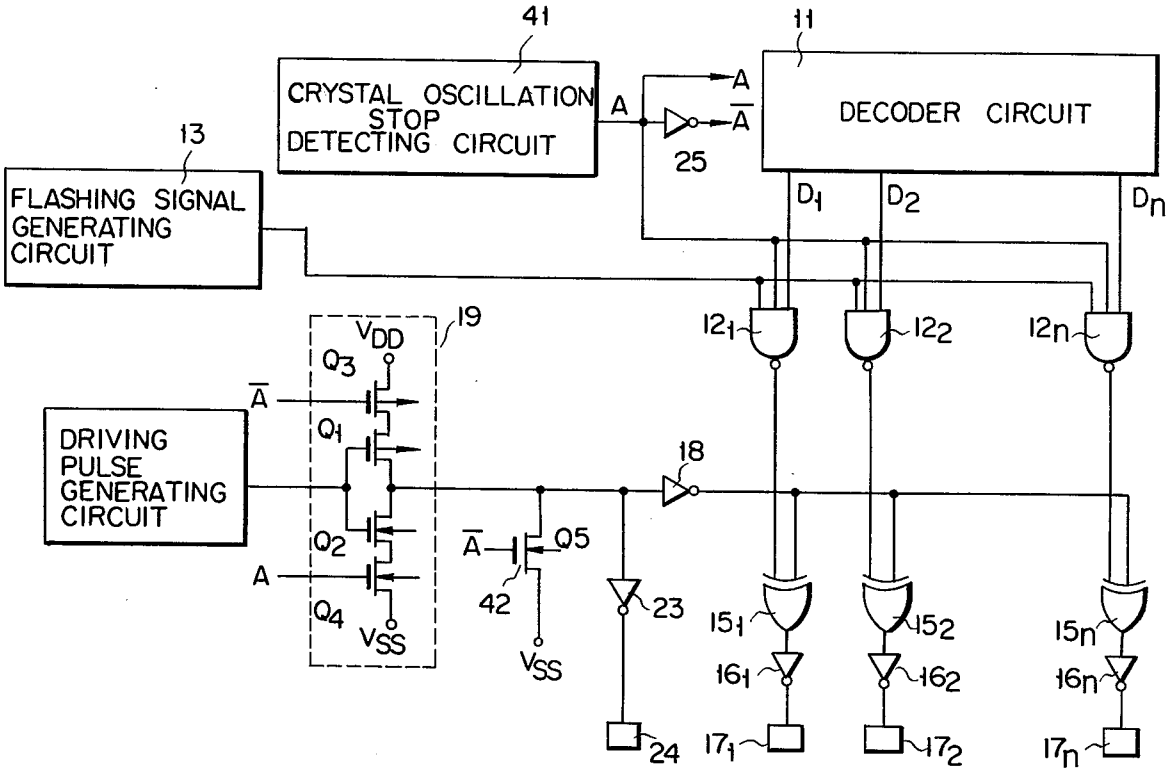
FIG. 4 sets forth the arrangement of a liquid crystal display element driving circuit according to a second embodiment of the invention.

FIG. 4 shows the arrangement of a liquid crystal display element-driving circuit according to another embodiment of this invention. The circuits shown in FIG. 4 is partly same as those shown in FIG. 2, and the same number is attached to the corresponding blocks and logical gates, so explanation about the same part is omitted. Only the different parts of FIG. 4 from FIG. 2 will now be described. Referential numeral 41 denotes a crystal oscillation stop-detecting circuit, which acts like the first logical level voltage-generating circuit 14 of FIG. 1 additionally provided with the following function. Namely, said crystal oscillation stop-detecting circuit 41 produces high logical level voltage "H", while a crystal oscillator containues oscillation and generates low logical level voltage "L" when the oscillation of the crystal is brought to an end. With an ordinary digital electronic timepiece, clock pulses generated by the crystal oscillator are used as a fundamental source of timecounting pulses. The crystal oscillator comprises crystal, and active and passive elements. These elements are partly included in the LSI circuitry. When the LSI circuitry is supplied with power, the crystal oscillator commences oscillation. A power source is generally a cell. When the cell voltage drops, the crystal oscillator ceases oscillation. With a digital electronic timepiece using liquid crystal as a display element, however, even when the crystal oscillator stops oscillation, decreased cell voltage is still supplied to the LSI circuitry, causing a certain amount of D.C. voltage to be impressed on the segement terminals $17_1$ to $17_n$ and common segment terminal 27. This means that D.C. voltage is supplied to the liquid crystal when the crystal oscillation is brought to an end with the resultant deterioration of the liquid crystal.

Figure 5:
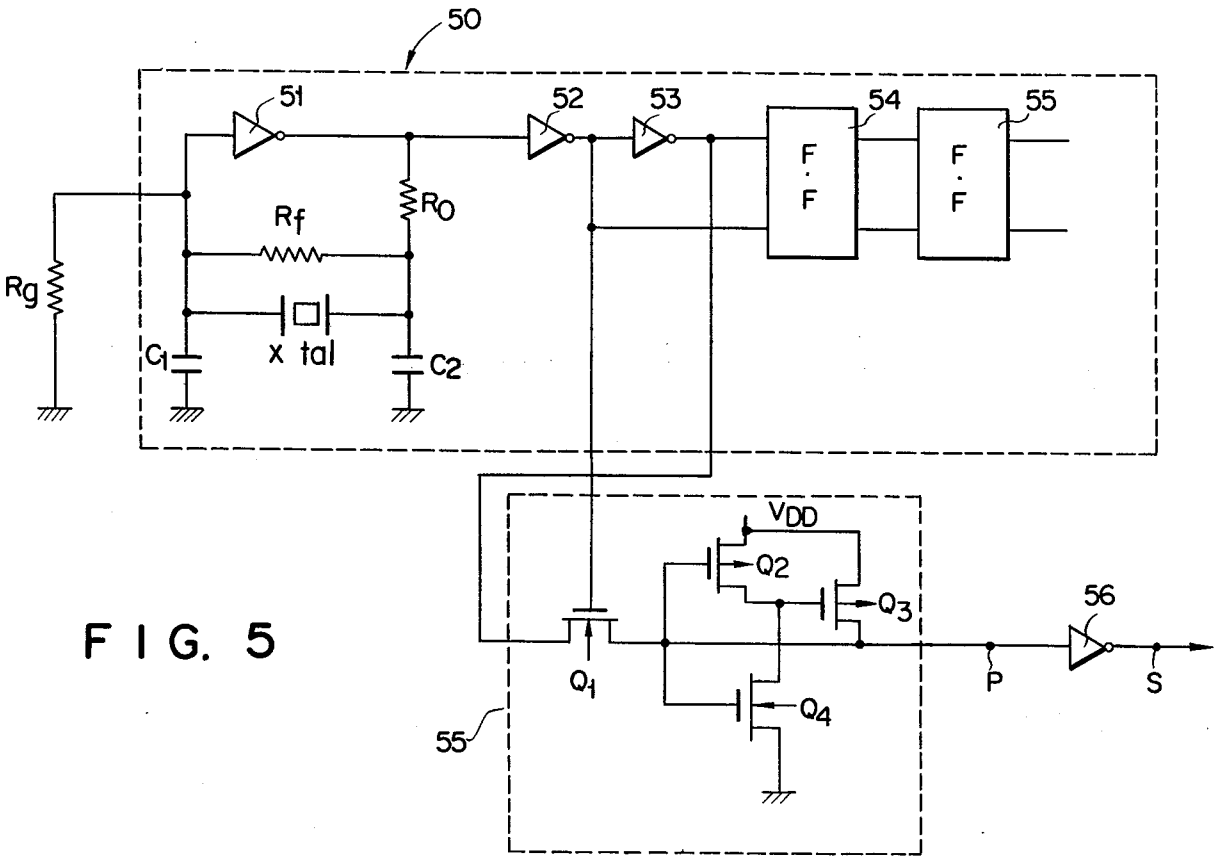
FIG. 5 indicates the circuit arrangement of a liquid crystal oscillation stop-detecting circuit.

There will now be described the operation of the crystal oscillation stop-detecting circuit 41 by reference to the above-mentioned facts. FIG. 5 shows the circuit arrangment of said circuit 41. A section enclosed in broken lines denotes an ordinary crystal oscillator 50. The crystal oscillator 50 comprises an oscillation stage consisting of a crystal oscillation element X-tal, capacitors $C_1$, $C_2$, resitors $R_f$, $R_o$ and oscillation inverter 51, and a frequency dividing stage in which flip-flop circuits 54, 55 divide the frequency of an output carried from the oscillation section through inverters 52, 53 to said flip-flop circuits 54, 55. One end of a high resistor $R_g$ disposed outside of the ordinary crystal oscillator 50 is connected to the input side of the oscillation inverter 51 of said crystal oscillator 50, and the other end of the high resistor $R_g$ is grounded. According to the second embodiment of this invention, the ordinary crystal oscillator 50 is further provided with a monostable circuit 55 formed of transistors $Q_1$ to $Q_4$ and an inverter 56. The output terminal of the inverter 52 of the ordinary crystal oscillator 50 is connected to the gate terminal of the transistor $Q_1$ of the monostable circuit 55. The output terminal of the inverter 53 of the ordinary crystal oscillator 50 is connected to the drain terminal of the transistor $Q_1$. When the transistor $Q_1$ is turned off, the monostable circuit 55 becomes stable, because the point P is impressed with high logical level voltage "H". An output signal A from the crystal oscillation stop-detecting circuit 41 is supplied in common to the NAND gates $12_1$ to $12_n$. Referential numeral 42 denotes a transistor $Q_5$ (FIG. 4) connected to the output side of the switch circuit 19 for its control.

There will now be described the operation of a liquid crystal display element-driving circuit according to the second embodiment of FIG. 4, which is constructed as described above.

a. When the LSI is supplied with normal cell voltage, and the crystal oscillator 50 (FIG. 5) of the LSI circuitry works in a normal mode, then the gate terminal of the transistor $Q_1$ of the monostable circuit 55 is supplied for some period, for example, with high logical level voltage "H" and the drain terminal of the transistor $Q_1$ is impressed with low logical level voltage "L". Conversely when the gate terminal of the transistor $Q_1$ is supplied with low logical level voltage "L", then the drain terminal of the transistor $Q_1$ is impressed with high logical level voltage "H". In either case, the point P is supplied with low logical level voltage "L". As the result, the point S on the output side of the inverter 56 is impressed with high logical level voltage "H". As the result, an output A from the liquid crystal oscillation stop-detecting circuit 41 has high logical level voltage "H", causing the transistors $Q_1$, $Q_2$ of the switch circuit 19 jointly constituting an inverter to be rendered operative as previously described in connection with FIG. 1. Since, at this time, the control transistor $Q_5$ 42 becomes inoperative, the switch circuit 19 acts as an ordinary inverter. Therefore, as in the ordinary case (a) of the first embodiment, clock pulses from the driving pulse-generating circuit 20 appear between the segment terminals $17_1$ to $17_n$ and common segment terminal 24 of the crystal display element-driving circuit of FIG. 4 in the same inphase (nondisplay mode) or reverse in-phase (display mode). These clock pulses are supplied to the segment electrodes of a liquid crystal display element and a common electrode, attaining a desired display of time data.

b. Where the cell voltage drops and the crystal oscillator stops oscillation, then an input to the oscillation inverter 51 of the crystal oscillator 50 of FIG. 5 is converted into low logical level voltage by the high resistor $R_g$. As the result, the gate terminal of the transistor $Q_1$ of the monostable circuit 55 is impressed with low logical level voltage "L" and the drain terminal of the transistor $Q_1$ is supplied with high logical level voltage "H", causing the transistor $Q_1$ to be rendered inoperative. Accordingly, the point P is impressed with high logical level voltage "H", and the point S is supplied with low logical level voltage "L". Eventually, an output A from the crystal oscillation stopdetecting circuit 41 has low logical level voltage "L". As the result, the transistors $Q_1$, $Q_2$ of the switch circuit 19 (FIG. 5) become inoperative and the control transistor $Q_5$ 42 is rendered conducting, causing the switch circuit 19 acting as an inoperative inverter to produce low logical level voltage "L". The common segment terminal 24 is impressed with the high logical level voltage "H" of an output from the switch circuit 19 which was inverted by the inverter 23. On the other hand, the input terminals of the respective NAND gates $12_1$ to $12_n$ are supplied with the output A from the crystal oscillation stop-detecting circuit 41 which now has low logical level voltage "L", causing the NAND gates $12_1$ to $12_n$ to produce high logical level voltage "H". Low logical level voltage "L" output from the switch circuit 19 is inverted into a high logical level "H" form by the inverter 18. Thus both input terminals of the respective exclusive OR gates $15_1$ to $15_n$ are impressed with high logical level voltage "H", causing said OR gates $15_1$ to $15_n$ to generate low logical level voltage "L" outputs, which in turn are inverted by the corresponding inverters $16_1$ to $16_n$. As the result, the segment terminals $17_1$ to $17_n$ are supplied with high logical level voltage "H". Namely, when crystal oscillation is brought to an end, the segment terminals $17_1$ to $17_n$ and common segment terminal 24 are all impressed with the same high logical level voltage "H". Consequently, the liquid crystal is not impressed with any D.C. voltage, but is saved from deterioration and shortened life. So even when the timepiece is kept in ususual mode, that is to say, in stopping mode due to the decrease of the power of a cell, above mentioned circuit in the timepiece effectively works to prevent liquid crystal from being impressed by D.C. voltage.

Where it is desired not to display any time data on a digital electronic timepiece, then all the liquid crystal-driving terminals can be impressed with the same logical level voltage. In this case, the NAND gates $12_1$ to $12_n$, switch circuit 19 and transistor $Q_5$ 42 are impressed with prescribed logical level voltage by a switch disposed outside of the digital electronic timepiece, thereby carrying out the same function as that of the crystal oscillation stop-detecting circuit and in consequence prominently extending the effective life of liquid crystal.

This invention is not limited to the above-mentioned embodiments, and various changes and modifications can be made without departing from the spirit and scope of this invention.

What is claimed is:

1. A driving circuit for a liquid crystal display device for causing the segment electrodes of a liquid crystal element to indicate prescribed data, which comprises a plurality of multi-input type NAND gates supplied with outputs from a decoder circuit for decoding coded data; a first logical level voltage-generating circuit for impressing prescribed logical level voltage in common to the NAND gates; a plurality of exclusive OR gates supplied with outputs from the NAND gates; a driving pulse-generating circuit for supplying liquid crystal-driving pulses to the exclusive OR gates; a second logical level voltage-generating circuit for sending forth an output to the exclusive OR gates, thereby producing prescribed logical level voltage; and switch circuit provided between the driving pulse-generating circuit or second logical level voltage-generating circuit and the exclusive OR gates, whereby the segment electrodes of a liquid crystal display element are selectively supplied with liquid crystal-driving pulses generated by the driving pulse-generating circuit or prescribed logical level voltage according to the combinations of logical level voltage outputs from the first and second logical level voltage-generating circuits.

2. The driving circuit for a liquid crystal display device according to claim 1, wherein the switch circuits are each formed of a plurality of metal oxide silicon transistors, two of which jointly act as an inverter; one of the remainder of said transistors is provided on the drain side of one of said paired transistors so as to be used as transfer gate; and the other of the remainder of said transistors is disposed on the source side of the other of said paired transistors so as to be used as transfer gate.

3. The driving circuit for a liquid crystal display device according to claim 1, wherein the switch circuits are each formed of a plurality of metal oxide silicon transistors, two of which are coupled together act as an inverter and connected to the output terminal of an inverter jointly constituted by the remaining two of said plural metal oxide silicon transistors so as to be transfer gate.

4. A driving circuit for a liquid crystal display device for causing the segment electrodes of a liquid crystal element to indicate prescribed data, which comprises a plurality of multiinput type NAND gates supplied with outputs from a decoder for decoding coded data; a crystal oscillation stop-detecting circuit designed to send forth an output in common to the NAND gates, generate first logical level voltage while a crystal oscillator is carrying out oscillation and produce second logical level voltage when crystal oscillation is brought to an end; a plurality of exclusive OR gates supplied with outputs from the NAND gates; a driving pulse-generating circuit for supplying crystal-driving pulses to the exclusive OR gates; and switch circuits provided between the driving pulse-generating circuit and exclusive OR gates and controlled by an output from the crystal oscillation stop-detecting circuit, wherein all the segment electrodes of the liquid crystal display element are impressed with the same logical level voltage when the crystal oscillation stop-detecting circuit detects the stop of crystal oscillation by the crystal oscillator.

5. The driving circuit for a liquid crystal display device according to claim 4, wherein the crystal oscillation stop-detecting circuit comprises a high resistor; a monostable circuit connected to the output terminal of the oscillation stage of the crystal oscillator; and an inverter connected to the monostable circuit.

* * * * *